US011497953B1

(12) United States Patent
Naparstek et al.

(10) Patent No.: US 11,497,953 B1
(45) Date of Patent: Nov. 15, 2022

(54) RESISTANCE EXERCISE APPARATUS ENABLING CONCURRENT MULTIPLE WORKOUT MOVEMENTS

(71) Applicants: Joel Naparstek, Jacksonville, FL (US); Montell Owens, Jacksonville Beach, FL (US); Blake McCoy, Jacksonville, FL (US)

(72) Inventors: Joel Naparstek, Jacksonville, FL (US); Montell Owens, Jacksonville Beach, FL (US); Blake McCoy, Jacksonville, FL (US)

( * ) Notice: Subject to any disclaimer, the term of this patent is extended or adjusted under 35 U.S.C. 154(b) by 0 days.

(21) Appl. No.: 16/157,081

(22) Filed: Oct. 10, 2018

Related U.S. Application Data

(60) Provisional application No. 62/570,284, filed on Oct. 10, 2017.

(51) Int. Cl.
*A63B 21/00* (2006.01)
*A63B 21/02* (2006.01)
*A63B 21/055* (2006.01)

(52) U.S. Cl.
CPC .. *A63B 21/00043* (2013.01); *A63B 21/00185* (2013.01); *A63B 21/028* (2013.01); *A63B 21/0552* (2013.01); *A63B 21/4013* (2015.10); *A63B 21/4025* (2015.10)

(58) Field of Classification Search
CPC ..... A63B 21/00043; A63B 21/4025; A63B 21/028; A63B 21/00185; A63B 21/4013; A63B 21/0552
See application file for complete search history.

(56) References Cited

U.S. PATENT DOCUMENTS 650,656 A * 5/1900 Raabe ..... A63B 21/0552 482/124
1,618,273 A * 2/1927 Davidson ..... A63B 21/0004 482/124
2,613,932 A * 10/1952 Manners ..... A63B 21/4007 482/124
4,019,734 A * 4/1977 Lee ..... A63B 21/0552 482/125
4,245,840 A 1/1981 Van Housen
4,889,336 A 12/1989 Schneiderman
4,948,117 A * 8/1990 Burke ..... A63B 69/12 482/129
5,040,788 A * 8/1991 Randall ..... A63B 21/0552 473/229
5,176,377 A 1/1993 Wilkinson
5,186,701 A * 2/1993 Wilkinson ..... A41D 13/0015 482/121
5,190,512 A * 3/1993 Curran ..... A63B 21/0004 482/122

(Continued)

*Primary Examiner* — Garrett K Atkinson

(57) ABSTRACT

A resistance exercise apparatus enabling multiple concurrent workout/exercise movements includes a pair of handles adapted to be gripped by the hands of a user, a pair of first couplers connected to the pair of handles, a second coupler, a pair of ankle bands being adjustable to grip lower legs of the user above the ankles, and a plurality of elastic cords made of flexible and stretchable material. Selected ones of the plurality of elastic cords connect to and extend between the pair of first couplers and the second coupler and also connect to and extend between the second coupler and the pair of ankle bands.

7 Claims, 10 Drawing Sheets

(56) References Cited

U.S. PATENT DOCUMENTS 5,203,754 A * 4/1993 Maclean ..... A63B 21/0004 482/121
5,336,151 A * 8/1994 Van Ballegooie ..... A63B 21/00185 482/121
5,362,295 A * 11/1994 Nurge ..... A63B 21/00061 482/121
5,372,565 A * 12/1994 Burdenko ..... A63B 21/0552 482/124
5,643,159 A * 7/1997 Lavarone ..... A63B 21/0004 482/125
5,647,827 A * 7/1997 Gutkowski ..... A63B 21/0004 482/122
5,683,336 A * 11/1997 Pape ..... A63B 21/0004 482/111
5,720,042 A * 2/1998 Wilkinson ..... A41D 13/0015 2/69
5,803,881 A * 9/1998 Miller ..... A63B 21/0004 482/124
5,807,218 A * 9/1998 Nagatomo ..... A61F 5/3715 128/869
5,993,362 A * 11/1999 Ghobadi ..... A63B 21/0004 482/121
6,099,446 A * 8/2000 Johnson ..... A63B 21/0004 482/124
6,287,242 B1 * 9/2001 Fray ..... A63B 21/0004 482/121
6,517,470 B1 * 2/2003 Chak ..... A63B 21/0004 482/121
6,629,912 B2 10/2003 Downs
6,984,184 B2 * 1/2006 Gray ..... A63B 21/0004 473/458
7,004,892 B2 2/2006 Marco
7,297,093 B2 11/2007 Garcia Lopez
7,326,157 B2 * 2/2008 Wu ..... A63B 21/0004 482/121
7,563,212 B2 7/2009 Smith
7,601,107 B2 10/2009 Maloy et al.
7,608,026 B1 * 10/2009 Nicassio ..... A63B 21/00185 24/265 BC
7,651,450 B2 1/2010 Wehrell
7,744,511 B2 * 6/2010 Grigoriev ..... A61F 5/0102 482/121
7,833,140 B2 * 11/2010 Ligrano ..... A63B 21/00043 482/124
7,874,970 B2 1/2011 Glisan
7,998,034 B1 * 8/2011 Cobo ..... A63B 69/0028 482/126
7,998,041 B1 * 8/2011 Johnson ..... A63B 21/0552 482/124
8,002,681 B2 8/2011 Kopp
8,038,586 B2 10/2011 Biisset
D698,877 S * 2/2014 Calvin ..... D21/692
9,272,178 B2 3/2016 Pinder
9,314,658 B2 4/2016 Kaye
9,327,156 B2 5/2016 von Hoffmann et al.
9,415,254 B2 8/2016 Dyer
9,764,180 B2 * 9/2017 Bybee ..... A63B 23/03575
2002/0187884 A1 * 12/2002 McGrath ..... A63B 21/0552 482/121
2003/0186791 A1 10/2003 Downs
2004/0116259 A1 * 6/2004 Rosiles ..... A63B 5/16 482/121
2005/0059537 A1 3/2005 Hull
2005/0282689 A1 12/2005 Weinstein
2007/0135279 A1 6/2007 Purdy et al.
2008/0108486 A1 * 5/2008 Vigilia ..... A63B 21/0004 482/124
2009/0062087 A1 3/2009 Poppinga
2010/0041528 A1 2/2010 Todd
2011/0021329 A1 1/2011 Dunne
2011/0111890 A1 5/2011 Webb et al.
2012/0202658 A1 * 8/2012 Menefee, Sr. ... A63B 21/00061 482/124
2012/0264535 A1 10/2012 O'Brien
2013/0045842 A1 2/2013 Wood
2014/0342884 A1 11/2014 Aldridge et al.
2015/0031511 A1 1/2015 Matthews
2015/0141217 A1 5/2015 Young
2015/0251038 A1 9/2015 Bybee et al.
2015/0335937 A1 11/2015 Park
2015/0360076 A1 12/2015 Celebrini et al.
2017/0028245 A1 2/2017 Williams

* cited by examiner

RESISTANCE EXERCISE APPARATUS ENABLING CONCURRENT MULTIPLE WORKOUT MOVEMENTS

CROSS-REFERENCE TO RELATED APPLICATION(S)

This U.S. non-provisional patent application claims the benefit of U.S. provisional patent application No. 62/570,284, filed on Oct. 10, 2017, the entire content of which is incorporated-by-reference herein.

FIELD OF THE INVENTION

The present invention relates generally to exercise/workout equipment for strengthening upper and lower body muscles, core muscles, and cardiovascular muscles. More particularly, the invention pertains to such exercise equipment incorporating resistance bands to enable multiple concurrent workout movements.

BACKGROUND OF THE INVENTION

Health and performance benefits a person can gain from frequent participation in comprehensive workouts of upper and lower body, body core and cardiovascular muscles are well-known.

However, there are various factors working against frequent participation. One is the constraint that most people are under in terms of amount of time that available to spend doing frequent comprehensive workouts. Another is the stress one feels to have readily available multiple items of equipment needed to perform comprehensive workouts of upper and lower body, body core and cardiovascular muscles of the body.

Accordingly, there remains a need in the art for an innovation that will overcome the limitations of the known prior art and the problems that remain unsolved.

SUMMARY OF THE INVENTION

The present invention is directed to an innovation that overcomes the deficiencies of the known art and the problems that remain unsolved by providing a resistance exercise apparatus that enables concurrent multiple workout movements of upper and lower body, body core and cardiovascular muscles. The resistance exercise apparatus provides a single item of equipment, thereby overcoming the need for multiple items of equipment, and enables concurrent workout movements of the aforementioned areas of the body, thereby reducing the amount of time to do frequent comprehensive workouts.

In an exemplary implementation, a resistance exercise apparatus enabling concurrent multiple workout movements, includes:

a pair of handles adapted to be gripped by hands of a user;

a pair of first couplers connected to the pair of handles;

a second coupler;

a pair of adjustable ankle bands being adjustable to grip lower legs of the user above the ankles; and a plurality of elastic cords made of flexible and stretchable material, wherein selected ones of the plurality of elastic cords connect to and extend between the pair of first couplers and the second coupler and also connect to and extend between the second coupler and the pair of ankle bands.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
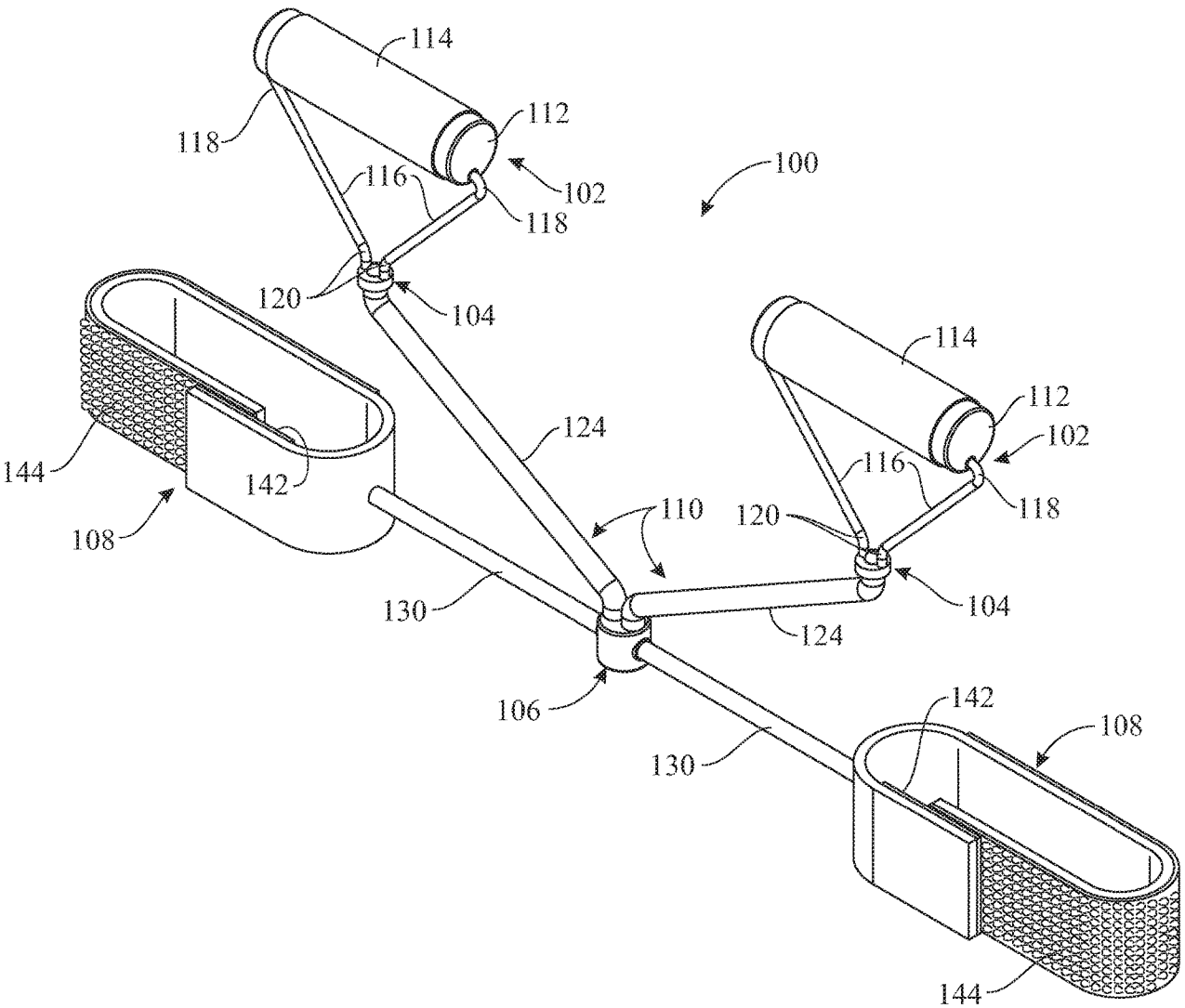
FIG. 1 presents an isometric view of an exemplary embodiment of a resistance exercise apparatus that enables concurrent multiple workout movements in accordance with aspects of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Referring now to FIGS. 1-4, there is illustrated an exemplary embodiment of a resistance exercise apparatus, generally designated 100, which enables an individual to concurrently perform multiple workout movements in accordance with aspects of the present invention. The resistance exercise apparatus generally includes a pair of handles 102, a pair of first couplers 104, a second coupler 106, a pair of ankle bands 108, and a plurality of elastic cords segments 110.

Figure 2:
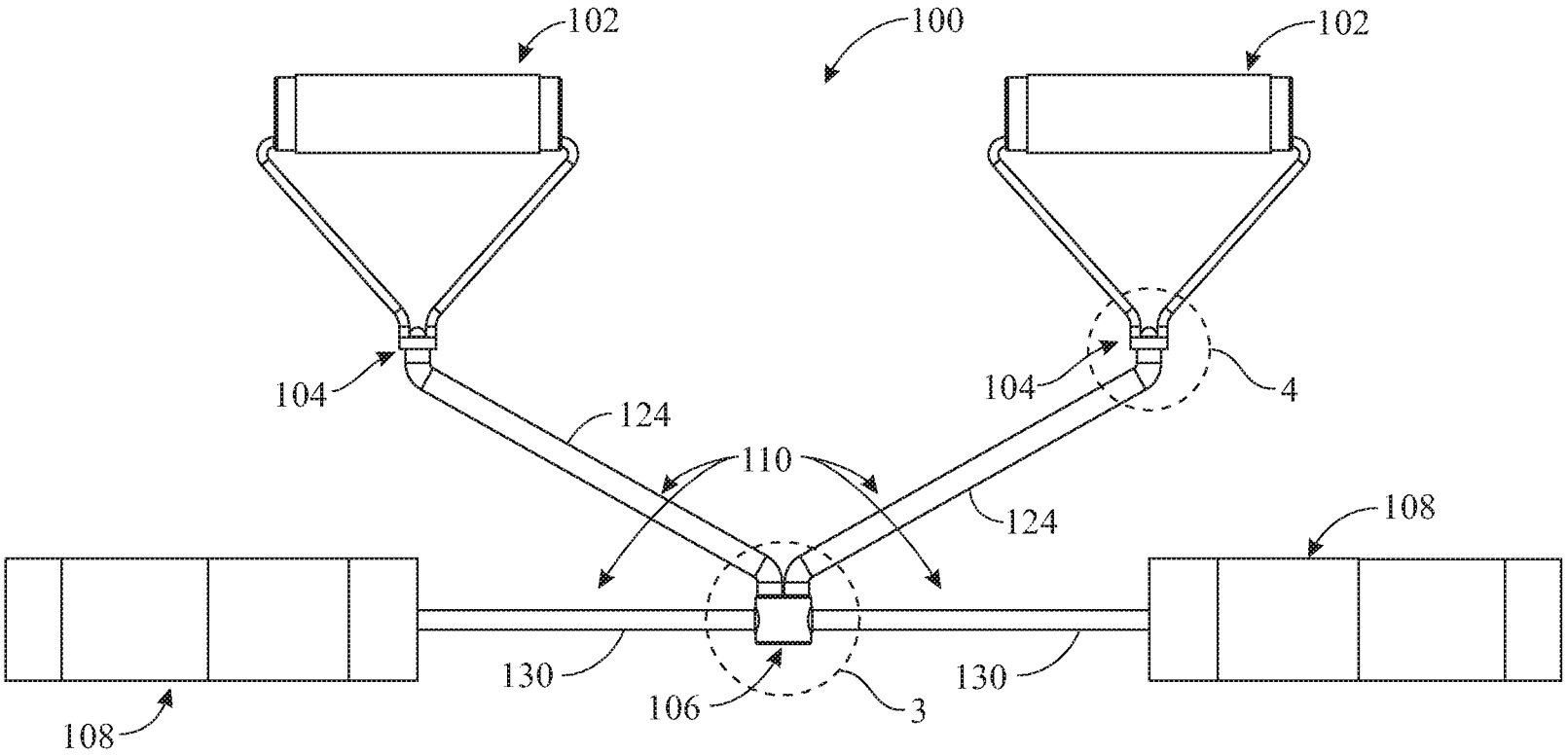
FIG. 2 presents a plan view of the resistance exercise apparatus originally introduced in FIG. 1.
Figure 4:
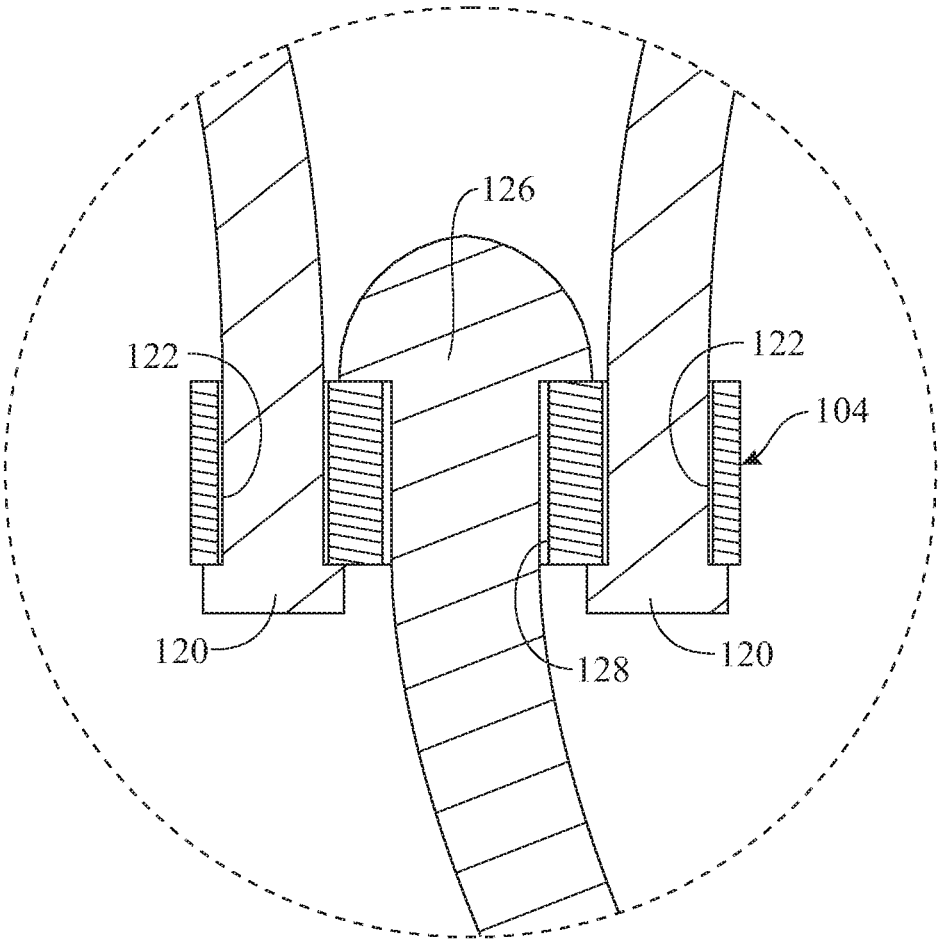
FIG. 4 presents an enlarged fragmentary sectional view of another portion of the resistance exercise apparatus encompassed by the dashed circle 4 in FIG. 2.

The handles 102 of the resistance exercise apparatus 100 are adapted to be gripped by hands of a user. Each of the pair of first couplers 104 is connected to one of the handles 102. More particularly, each handle 102 includes a cylindrical member 112, a tubular hand grip sleeve 114 that surrounds and is rotatable about the cylindrical member 112 as the sleeve 114 is gripped by the hand of the user, and a V-shaped support 116 that supports the cylindrical handle member 112 at its opposite ends. The V-shaped support 116 has a pair of first ends 118 that interconnect opposite ends of the cylindrical handle member 112 with one of the first couplers 104, as seen in FIGS. 1 and 2. Referring particularly to FIG. 4, the configurations of a pair of second ends 120 of the V-shaped support 116 of one of the handles 102 is shown interfitted or mated with a pair of outer orifices 122 of one of the first couplers 104. The V-shaped support 116 may be made of either a suitable rigid or flexible material.

Figure 3:
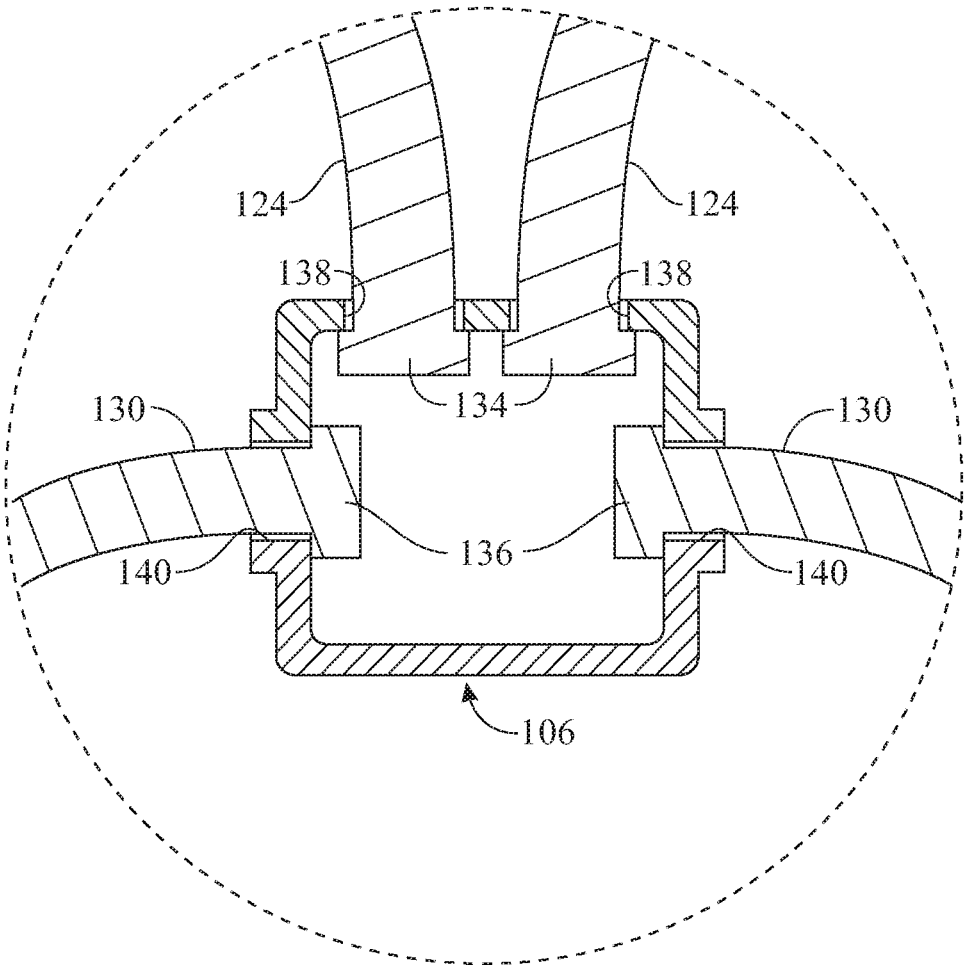
FIG. 3 presents an enlarged fragmentary sectional view of one portion of the resistance exercise apparatus encompassed by the dashed circle 3 in FIG. 2.

Referring now particularly to FIGS. 1, 2, and 4, selected ones of the plurality of elastic cords 110, specifically, the pair of the elastic cords 124 in FIGS. 1 and 2 at their first ends 126 (see FIG. 4) are rotatably connected to the first couplers 104 by being rotatably interfitted or mated with central orifices 128 of the first couplers 104, as shown in FIGS. 1 and 2. FIG. 4 shows the configuration of the first end 126 of each of the elastic cords 124 of the pair thereof. The pair of elastic cords 124 extend to the second coupler 106. Selected other ones of the plurality of elastic cords 110, specifically, the pair of elastic cords 130 in FIGS. 1 and 2, at their first ends 132 are fixedly connected to the pair of ankle bands 108. The pair of elastic cords 130 extend to the second coupler 106. The pair of elastic cords 124 at second ends 134 (e.g., see FIG. 3) thereof, and the pair of elastic cords 130 at second ends 136 (e.g., see FIG. 3) thereof, respectively, rotatably connect to the second coupler 106. FIG. 3 shows the configurations of the second ends 134, 136 of the first and second pairs of elastic cords 124, 130 extending through apertures 138, 140 of the second coupler 106. The first and second couplers 104, 106 are preferably constructed of a rigid plastic material. The plurality of elastic cords 110 may be constructed, for example, of latex or rubber material and may be in the form of either tubing or solid cords.

Figure 5:
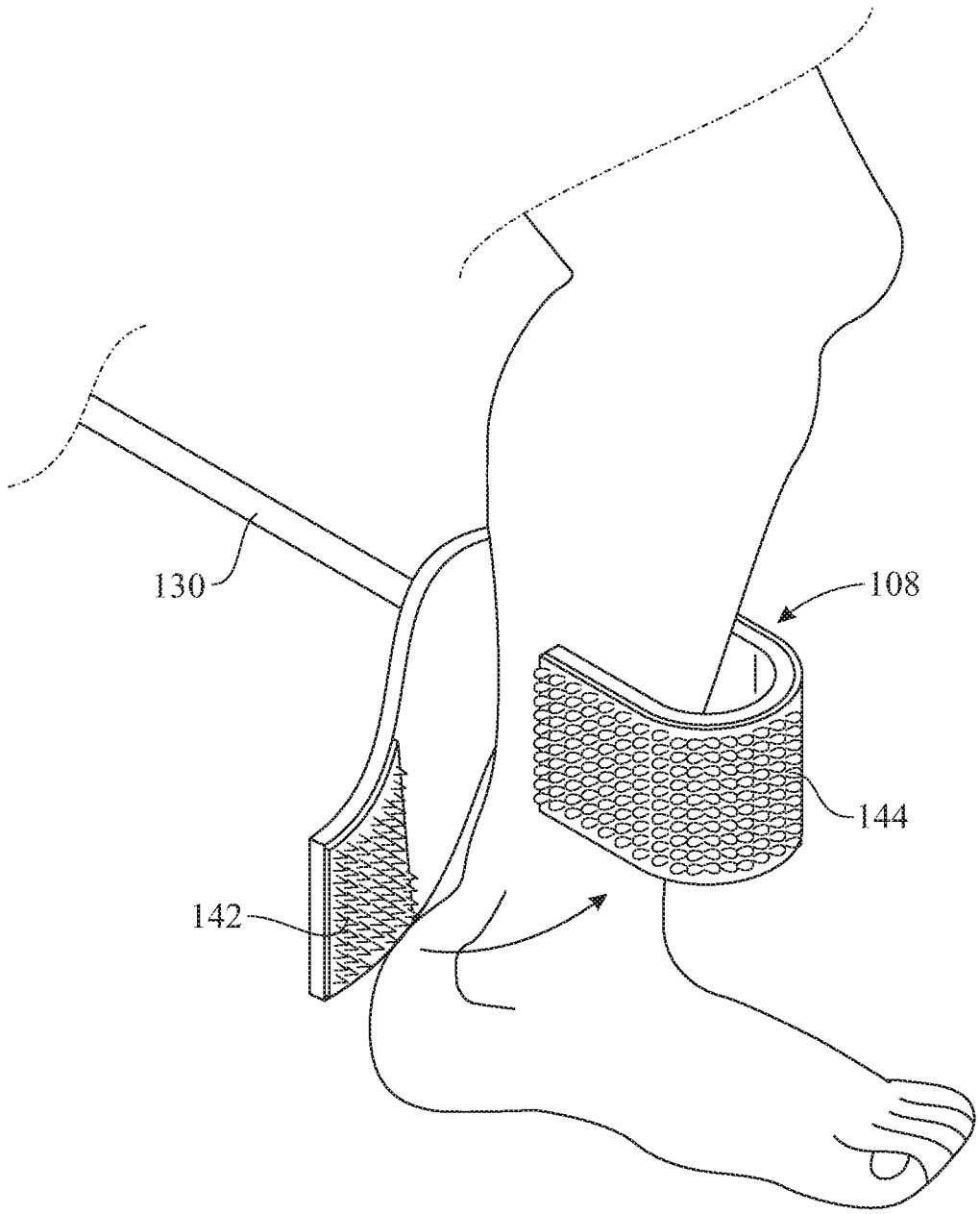
FIG. 5 presents an isometric fragmentary view of one of a pair of ankle bands of the resistance exercise apparatus originally introduced in FIG. 1, showing the process of applying the one ankle band to a lower leg of the user above the ankle.
Figure 6:
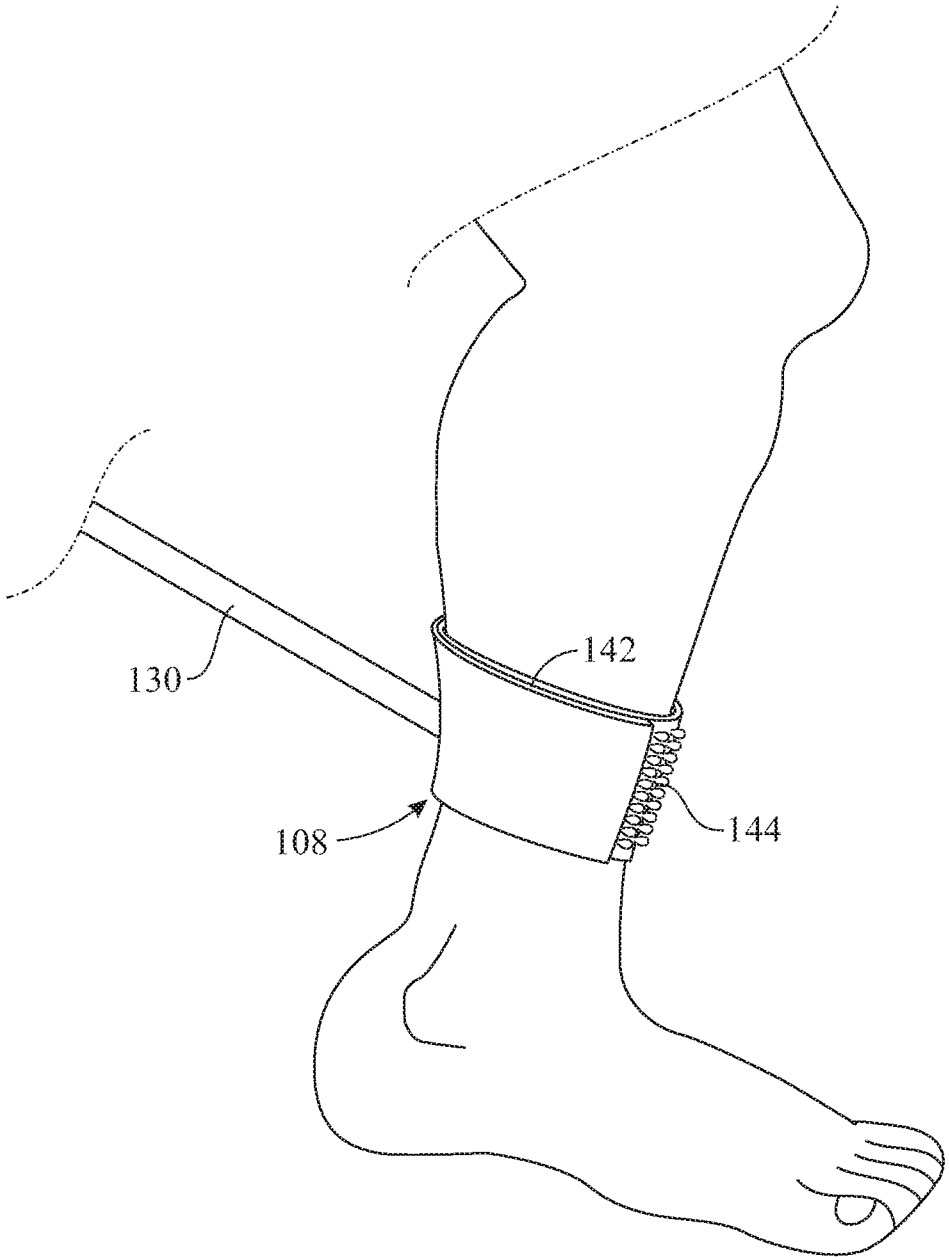
FIG. 6 presents an isometric fragmentary view of the one ankle band of the resistance exercise apparatus shown in FIG. 5 after completion of the process of applying the one ankle band to the lower leg of the user above the ankle.

Referring to FIGS. 5 and 6, there is shown one of the pair of ankle bands 108 of the resistance exercise apparatus 100 during, and at completion of, the process of applying the one ankle band 108 to a lower leg of the user above the ankle. The ankle bands 108 may take the form of straps of suitable elastic material with hook-and-loop fastener system patches 142, 144 disposed upon opposite surface thereon to enable releasable fastening of the ankle bands 108 about the user's lower legs.

Figure 7:
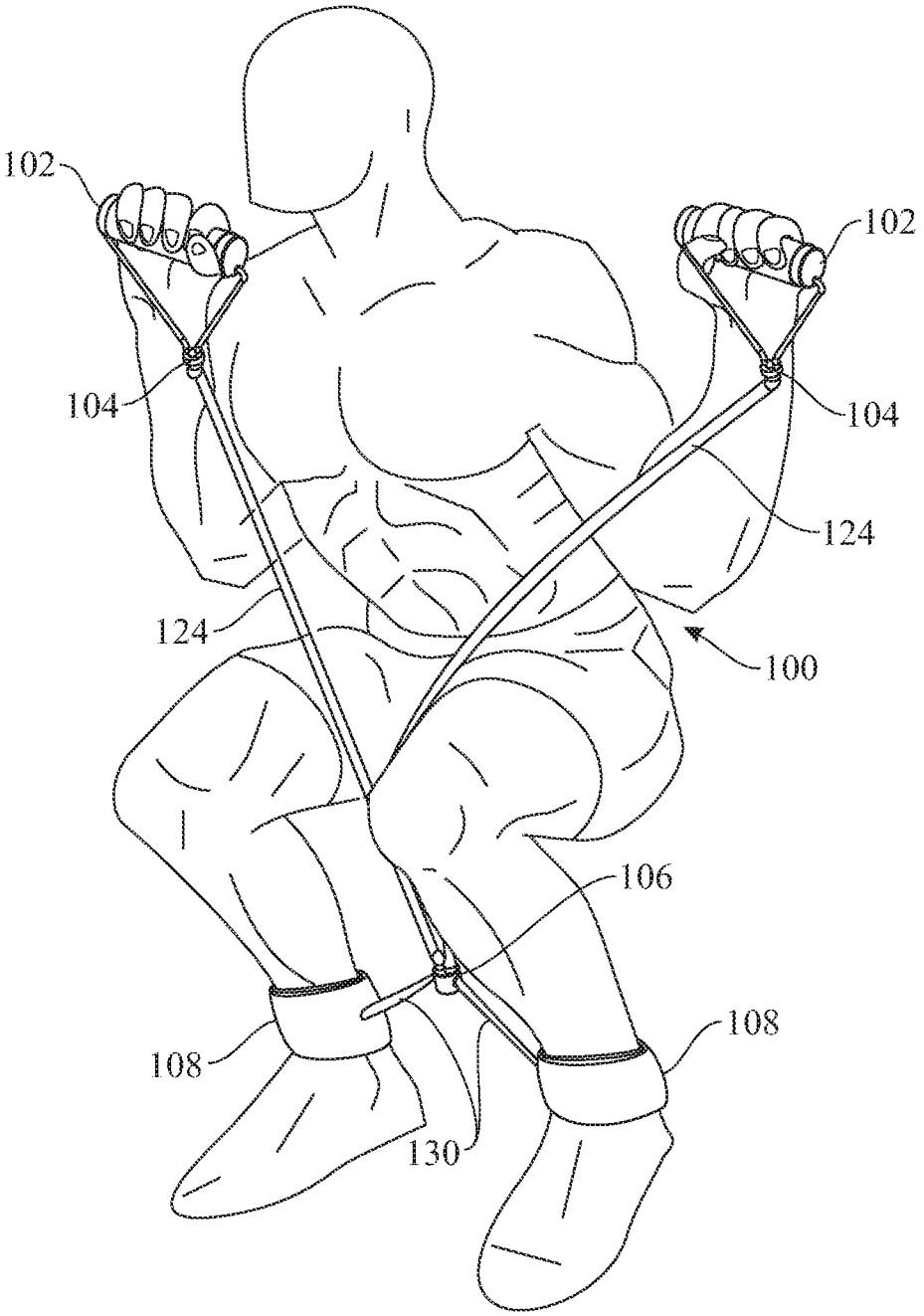
FIG. 7 presents a perspective view of a person performing one set of concurrent multiple workout movements using the resistance exercise apparatus originally introduced in FIG. 1.
Figure 8:
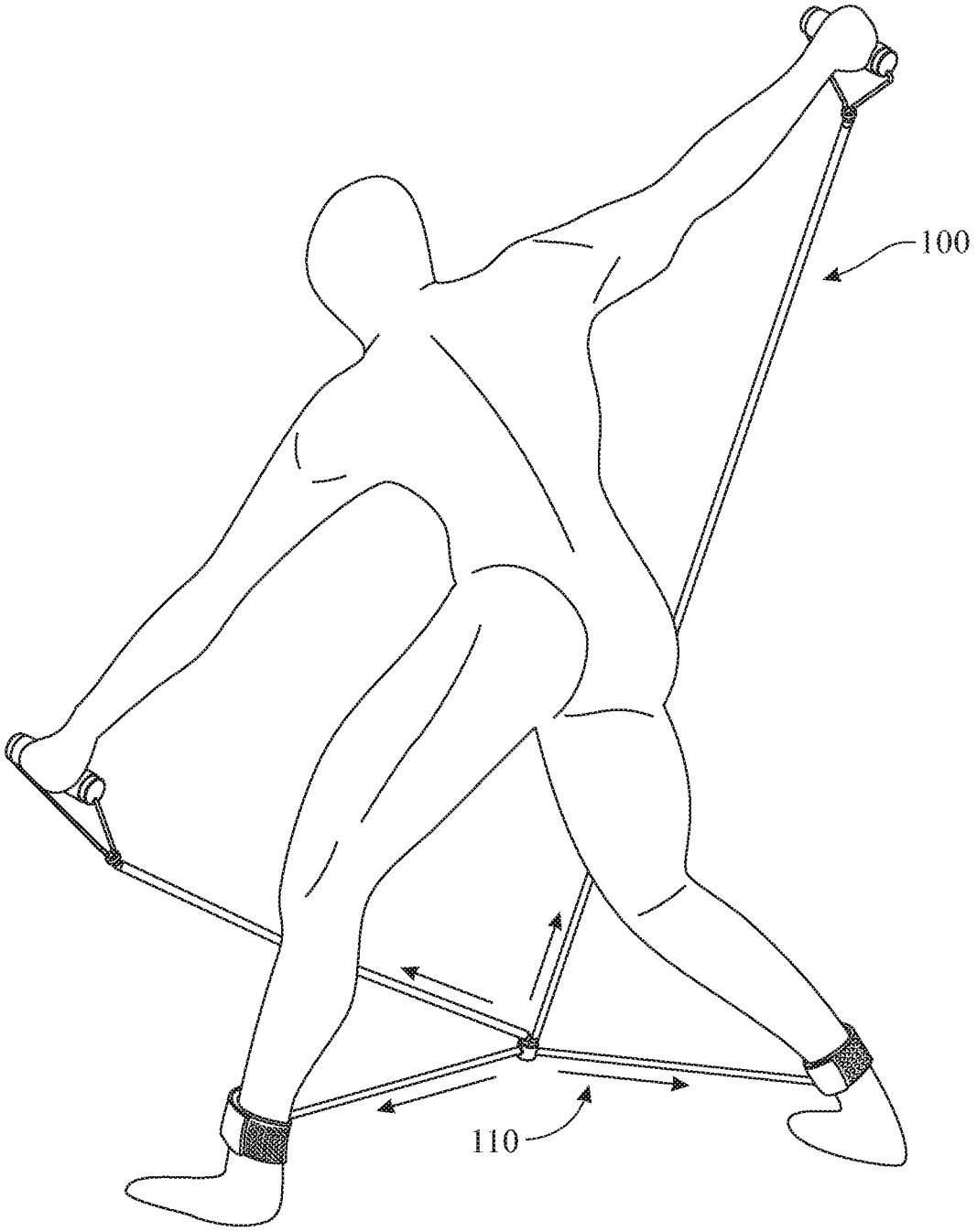
FIG. 8 presents a perspective view of a person performing another set of concurrent multiple workout movements using the resistance exercise apparatus originally introduced in FIG. 1.

Significantly, the resistance exercise apparatus 100 provides a single piece of equipment that enables concurrent resistance workout/exercise movements of these portions of the body in virtually every position and angle imaginable, enabling the aforementioned concurrent exercise of various regions of the body, for example, while the user is standing in place, walking, running/jogging, shuffling laterally, moving in a forward direction, moving in a rearward/backward direction, as well as, for example, on the ground in a push-up position or any of myriad other positions. With the resistance exercise apparatus disclosed herein, one can be performing lateral movements such as lateral, or side-to-side, shuffling, as depicted in FIG. 8, or, side step-squatting, as depicted in FIG. 7, while creating resistive forces to enable the user to work the body core while concurrently performing, for example, bicep curls, front raises, shoulder presses and more, all at once, in place or moving laterally.

Figure 9:
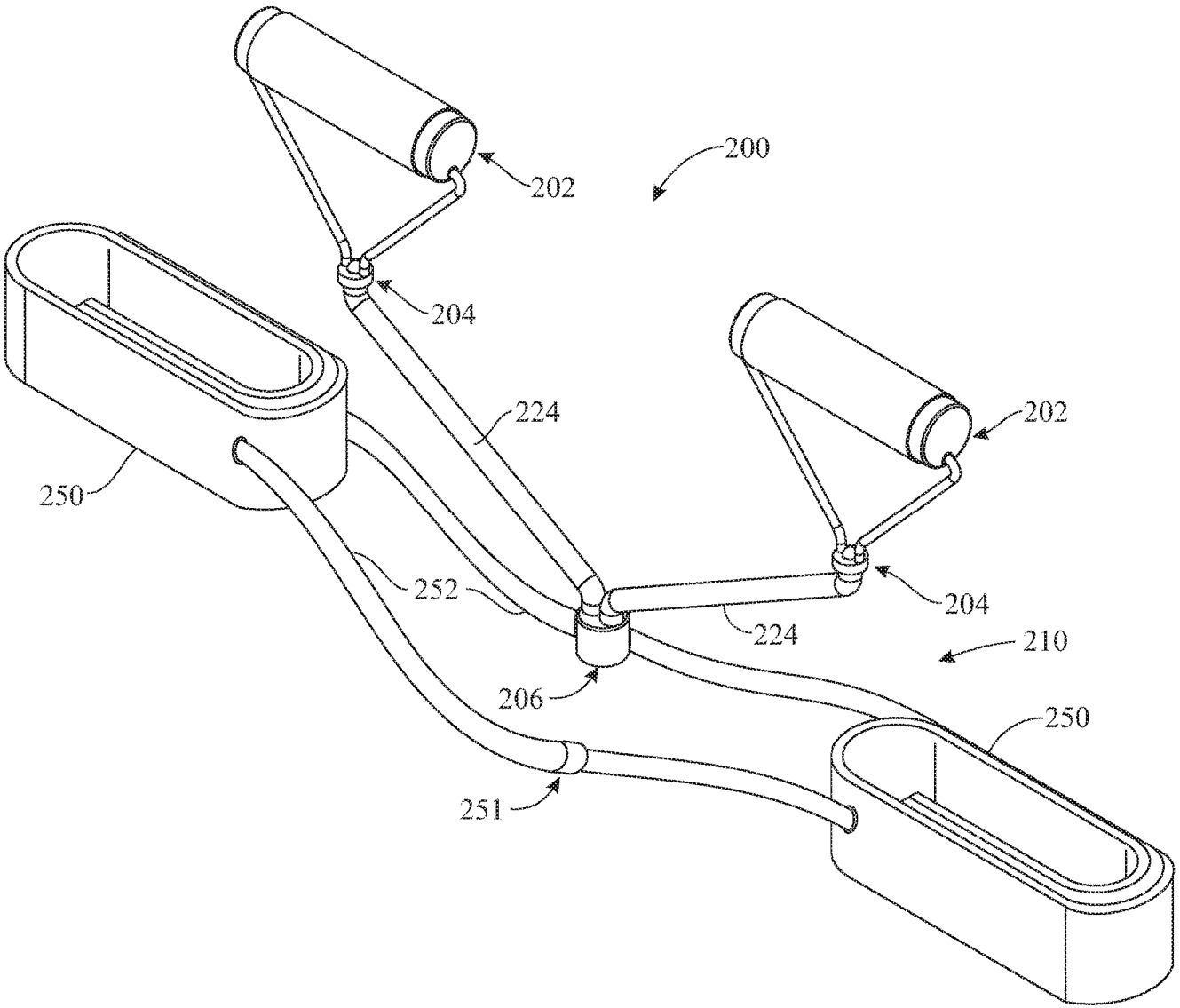
FIG. 9 presents an isometric view of a modified embodiment of a resistance exercise apparatus that enables concurrent multiple workout movements in accordance with aspects of the present invention.
Figure 10:
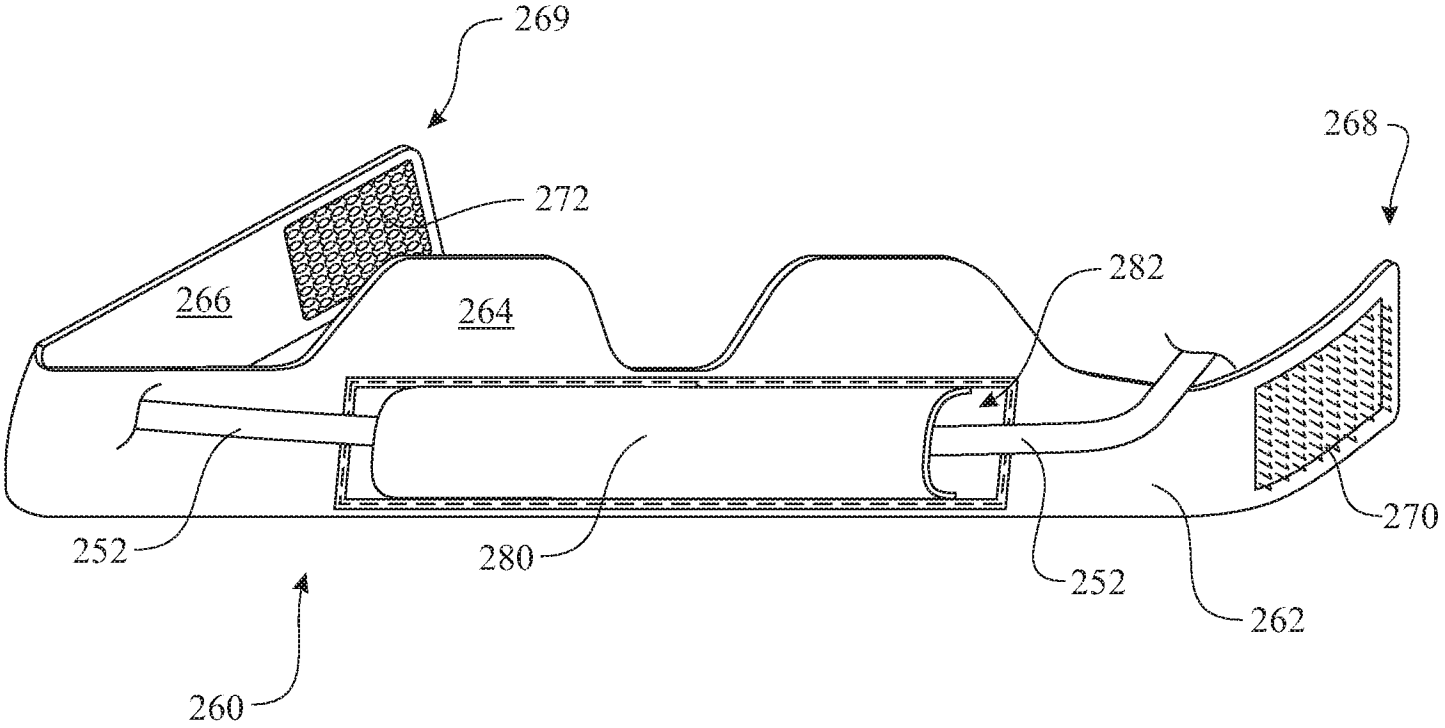
FIG. 10 presents an isometric view of an alternative implementation 260 of the adjustable ankle strap 250 shown in FIG. 9.

Referring now particularly to FIG. 9, a resistance-type exercise apparatus, generally designated as reference numeral 200, is shown in accordance with an alternative implementation of the invention. For clarity and convenience, the same reference numerals have been used to designate structural elements equivalent to those shown with respect to apparatus 100, except for a change in the prefix of the reference numerals from "1" (i.e. for elements pertaining to apparatus 100) to "2" (i.e. for elements pertaining to apparatus 200), indicating that, generally speaking, the modified embodiment 200 has the same basic components as the exemplary embodiment of the apparatus 100 shown in FIGS. 1-8. In other words, the modified embodiment of the apparatus 200 includes the same pair of handles 202, pair of first couplers 204, second coupler 206 and pair of elastic cords 224 of the plurality of elastic cords 210. In view of this, the detailed description of these same basis components need not be repeated hereinafter in order for one to gain a complete understanding of the modified implementation/embodiment of the apparatus 200.

More particularly, apparatus 200 incorporates a modified pair of ankle bands 250 and a pair of elastic cords 252 coupled at a third coupler 251 interconnecting the ankle bands 250 and the second coupler 206. Each of the modified ankle bands 250 may be made of the same flexible material using hook-and-loop system fastening material to releasably attach portions (e.g. opposite ends) of a strap to one another so as to route portions of the elastic cords 252 through portions of the ankle bands 250 such that the elastic cord 252 will encompass, or circumscribe the lower legs of the user at both the front and rear thereof. Although a pair of elastic cords 252 is preferably employed to interconnect the ankle bands 250 and the second coupler 206 of the apparatus 200, it will be readily apparent to those skilled in the art that a single elastic cord 252 may be employed in lieu thereof.

Significantly, as will be understood by those skilled in the art, both apparatuses 100, 200, by incorporating the plurality of elastic cords 110 in the configuration(s) shown and described herein, enable an individual workout wherein the upper and lower torso and the core are always integrated. The elastic cords 110 may be constructed so as to range from about a 5 lb. resistance level up to about a 70 lb. resistance level, which encompasses beginners up to advanced/elite athletes. Furthermore, it will be readibly understood that any combination of resistance level cords can be employed;

thereby, providing the user with the option to vary the resistance levels applied to both the upper and lower torso while working out.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A resistance exercise apparatus enabling a user to concurrently perform multiple workout movements, the apparatus comprising:

a left handle, comprising a left cylindrical member and a left tubular hand grip sleeve disposed upon the left cylindrical member and rotatable thereabout, adapted to be gripped by a left hand of the user;

a right handle comprising a right cylindrical member and a right tubular hand grip sleeve disposed upon the right cylindrical member and rotatable thereabout, adapted to be gripped by a right hand of the user;

a left upper coupler comprising a first unitary upper coupler body having a pair of outer channels extending completely therethrough and a first central channel extending completely therethrough;

a right upper coupler comprising a second unitary upper coupler body having a pair of outer channels extending completely therethrough and a second central channel extending completely therethrough;

a left V-shaped support interconnecting said left handle and said left upper coupler, wherein the left V-shaped support comprises:

a first left framework member having an upper end attached to a left end of the left handle cylindrical member and a lower end attached to the left upper coupler; and a first right framework member having an upper end attached to a right end of the left handle cylindrical member and a lower end attached to the left upper coupler;

a right V-shaped support interconnecting said right handle and said right upper coupler, wherein the right V-shaped support comprises:

a second left framework member having an upper end attached to a left end of the right handle cylindrical member and a lower end attached to the right upper coupler; and a second right framework member having an upper end attached to a right end of the right handle cylindrical member and a lower end attached to the right upper coupler;

a lower coupler;

a left upper elastic cord interconnecting said left upper coupler and said lower coupler;

a right upper elastic cord interconnecting said right upper coupler and said lower coupler;

a left adjustable ankle band releasably attachable to a left lower leg of the user above a respective left ankle;

a right adjustable ankle band releasably attachable to right lower leg of the user above a respective right ankle;

a left lower elastic cord interconnecting said left adjustable ankle band and said lower coupler; and a right lower elastic cord interconnecting said right adjustable ankle band and said lower coupler.

2. The resistance exercise apparatus recited in claim 1, wherein:

(a) the lower end of the left framework member of said left V-shaped support extends through a first one of said pair of outer channels of said left upper coupler, and the lower end of the right framework member of said left V-shaped support extends through a second one of said pair of outer channels of said left upper coupler; and (b) the lower end of the right framework member of said right V-shaped support extends through a first one of said pair of outer channels of said right upper coupler, and the lower end of the right framework member of said right V-shaped support extends through a second one of said pair of outer channels of said right upper coupler.

3. The resistance exercise apparatus recited in claim 2, wherein said lower coupler further comprises a hollow coupler body having a pair of upper apertures extending through an upper side thereof, a left aperture extending through a left side thereof, and a right aperture extending through a right side thereof.

4. The resistance exercise apparatus recited in claim 3, wherein:

(a) said left upper elastic cord has an upper end extending completely through the central channel of the unitary body of said left upper coupler, and a lower end extending through a first one of the pair of upper apertures extending through the upper side of the hollow coupler body of said lower coupler; and (b) said right upper elastic cord has an upper end extending completely through the central channel of the unitary body of said right upper coupler, and a lower end extending through a second one of the pair of upper apertures extending through the upper side of the hollow coupler body of said lower coupler, such that the lower ends of said right and left upper elastic cords are secured within an interior space of the hollow body of said lower coupler in a manner enabling rotation of the left and right upper elastic cords with respect to said lower coupler body, the right end of the left lower elastic cord is secured within the interior space of the hollow body of said lower coupler in a manner enabling rotation of the left lower elastic cord with respect to said lower coupler body, and the left end of the right lower elastic cord is secured within the interior space of the hollow body of said lower coupler in a manner enabling rotation of the right lower elastic cord with respect to said lower coupler body.

5. The resistance exercise apparatus recited in claim 4, wherein:

(a) said left lower elastic cord has a right end extending through the left side of the hollow body of said lower coupler, and a left end attached to said left ankle band; and (b) said right lower elastic cord has a left end extending through the right side of the hollow body of said lower coupler, and a right end attached to said right ankle band, such that the right end of said left lower elastic cord and the left end of the right lower elastic cord are rotatable with respect to said lower coupler body.

6. The resistance exercise apparatus recited in claim 4, wherein:

(a) said left lower elastic cord has a right end extending through the left side of the hollow body of said lower coupler, and a left end extending completely through said left ankle band;

(b) said right lower elastic cord has a left end extending through the right side of the hollow body of said lower coupler, and a right end extending completely through said right ankle band; and (c) the left end of said left lower elastic cord and the right end of said right lower elastic cord are interconnected by an auxiliary coupler.

7. The resistance exercise apparatus recited in claim 4, wherein each one of said left and right ankle bands further comprises:

a main panel of flexible material having opposite free ends, an interior surface, and an exterior surface; and a secondary panel of flexible material attached to the exterior surface of the main panel of flexible material in a configuration defining an elastic cord retention channel.

* * * * *